United States Patent [19]

Laroche

[11] Patent Number: 4,648,231

[45] Date of Patent: Mar. 10, 1987

[54] STRUCTURAL JOINT ELEMENT FOR PANELS

[76] Inventor: François X. Laroche, P.O. Box 1024, Waterloo (Quebec), Canada, J0E 2N0

[21] Appl. No.: 767,608

[22] Filed: Aug. 20, 1985

[51] Int. Cl.[4] ..... E04C 2/34; A44B 21/00

[52] U.S. Cl. ..... 52/775; 52/468; 52/772; 24/459

[58] Field of Search ..... 52/235, 471, 468, 771, 52/772, 775; 24/459, 575, 578, 587

[56] References Cited

U.S. PATENT DOCUMENTS

| | | | |
|---|---|---|---|
| 453,470 | 6/1891 | Geiger et al. | 52/471 |
| 3,367,077 | 2/1968 | Johnston | 52/468 |
| 3,380,210 | 4/1968 | Neal et al. | 52/235 |
| 3,488,906 | 1/1970 | Brooks | 52/235 |
| 4,251,964 | 2/1981 | Francis | 52/235 |
| 4,428,171 | 1/1984 | Harbin | 52/772 |
| 4,461,133 | 7/1984 | Laroche | 52/730 |

FOREIGN PATENT DOCUMENTS

| | | | |
|---|---|---|---|
| 963624 | 3/1975 | Canada | 52/471 |
| 79313 | 12/1950 | Czechoslovakia | 52/772 |
| 186402 | 10/1955 | Fed. Rep. of Germany | 52/772 |
| 1952446 | 5/1973 | Fed. Rep. of Germany | 52/772 |
| 1447831 | 12/1966 | France | 52/772 |
| 250217 | 12/1926 | Italy | 52/772 |
| 553915 | 1/1957 | Italy | 52/775 |
| 2990 | 6/1919 | Netherlands | 52/772 |
| 409325 | 9/1966 | Switzerland | 52/468 |

*Primary Examiner*—William F. Pate, III
*Assistant Examiner*—Michael Safavi
*Attorney, Agent, or Firm*—Robic, Robic & Associates

[57] ABSTRACT

A cross-like structural joint element having a pair of aligned lateral arms each formed with an anti-slip pedestal projecting from one face; a U-shaped first connector member having a pair of spaced legs projecting perpendicularly from said one face at adjoining ends of the lateral arms, facing surfaces of the legs having inwardly inclined teeth, and a second connector member projecting perpendicularly from the other face of the lateral arms at the adjoining ends; this connector member having a narrow neck portion joining the lateral arms and a wide portion extending from the narrow neck portion.

12 Claims, 5 Drawing Figures

STRUCTURAL JOINT ELEMENT FOR PANELS

The present invention relates to the joining of panels, particularly glass panels, together at the edges thereof and to the mounting of the thus joined panels to a supporting structure such as to a column, a roof rafter, a beam or the like supporting structures. Generally speaking, the invention is an improvement of the structural building unit disclosed in Canadian Patent No. 1,164,620 and the corresponding U.S. Pat. No. 4,461,133 that issued respectively on Apr. 3rd, 1984 and July 24, 1984.

It is a main object of the invention to provide a primary structural joint element for the above purpose, which joint element can readily be fixed to a support prior to the joint being completed by the application of the edges of the panels to be joined against this primary joint element, a secondary joint element being subsequently applied, which secondary joint element is connectable to the primary joint element to pressingly hold the panels against it. According to the invention, in the case of an open-framework structure such as a greenhouse for instance, where the building skeleton is made up of several columns and roof rafters, the mounting of the glass panels can be much facilitated and more rapidly achieved since all of the primary joint elements can be first mounted on the columns and rafters; the glass panels being then easily applied against the primary joint elements and held in position by the application of the secondary joint elements. Manpower cost can thus be appreciably reduced as the panel mounting time is shortened.

Accordingly, the invention as herein broadly claimed is a structural joint element having, in cross-section, a generally cross-like body comprising: a pair of aligned lateral arms, each formed with a pedestal projecting from one face of the arms, each pedestal having a free end with a roughened anti-slip surface; a U-shaped first connector member having a pair of straight legs spaced from one another to define therebetween a chamber having a bottom and an open end, the legs projecting perpendicularly from the one face and being integral with the lateral arms at adjoining ends of the lateral arms, wherein each of the legs of the first connector member is formed, inwardly of the chamber, with a series of teeth inclined toward the chamber bottom, and a second connector member integral with the lateral arms and projecting perpendicularly from the other face of the lateral arms at the adjoining ends; the second connector member having a narrow neck portion joining the lateral arms and a wide portion extending from the narrow neck portion.

According to another aspect, the invention is herein broadly claimed as a structural joint including a first and a second joint element, the first joint element having a generally cross-like body comprising:

- a pair of aligned lateral arms, each formed with a pedestal projecting from one face of the arms, each pedestal having a free end with a roughened anti-slip surface;
- a U-shaped first connector member having a pair of straight legs spaced from one another to define therebetween a chamber having a bottom and an open end, the legs projecting perpendicularly from the said one face and being integral with the lateral arms at adjoining ends of the lateral arms;

- a second connector member integral with the lateral arms and projecting perpendicularly from the other face of the lateral arms at the adjoining ends; the second connector member having a narrow neck portion joining the lateral arms and a wide portion extending from the narrow neck portion;
- wherein each of the first connector legs is formed, inwardly of the chamber, with a series of teeth inclined toward the chamber bottom, the second joint element having a generally T-shaped body comprising:

- a pair of aligned lateral arms integral with one another and having an inner face;
- a U-shaped third connector member having a pair of straight legs spaced from one another to define therebetween a chamber having a bottom and an open end, the legs projecting perpendicularly from the inner face of the lateral arms and being integral with the lateral arms at adjoining ends of the lateral arms;
- the spaced legs of the third connector member being formed, inwardly of the third connector chamber with a series of teeth inclined toward the third connector chamber bottom, and wherein the chambers of the first and third connectors are equal in width and the thickness of one of the legs of each of the first and third connector members is essentially equal to the width of the chambers, the legs being slid into respective ones of the chambers for interengagement of the teeth and interlocking of the first and third connector members selectively at one of a plurality of locations within the chambers.

The aforementioned second connector member is preferably trapezoidal in cross-section, having a small base portion which acts as the narrow neck. The lateral inclined faces and the wide base end face of this trapezoidal connector member may have outwardly projecting pointed ridges.

Alternatively and in another preferred embodiment, the wide portion of the second connector member may be outwardly circular in cross-section.

Other features and advantages of the invention will become apparent to those skilled in the art from the description that follows of a preferred embodiment having reference to the appended drawings wherein.

Figure 1:
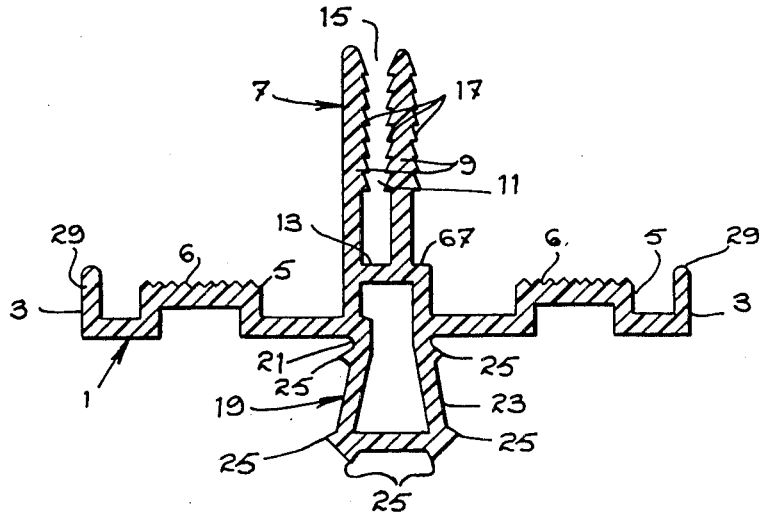
FIG. 1 is a cross-sectional view of a primary or first joint element made according to the invention.
Figure 2:
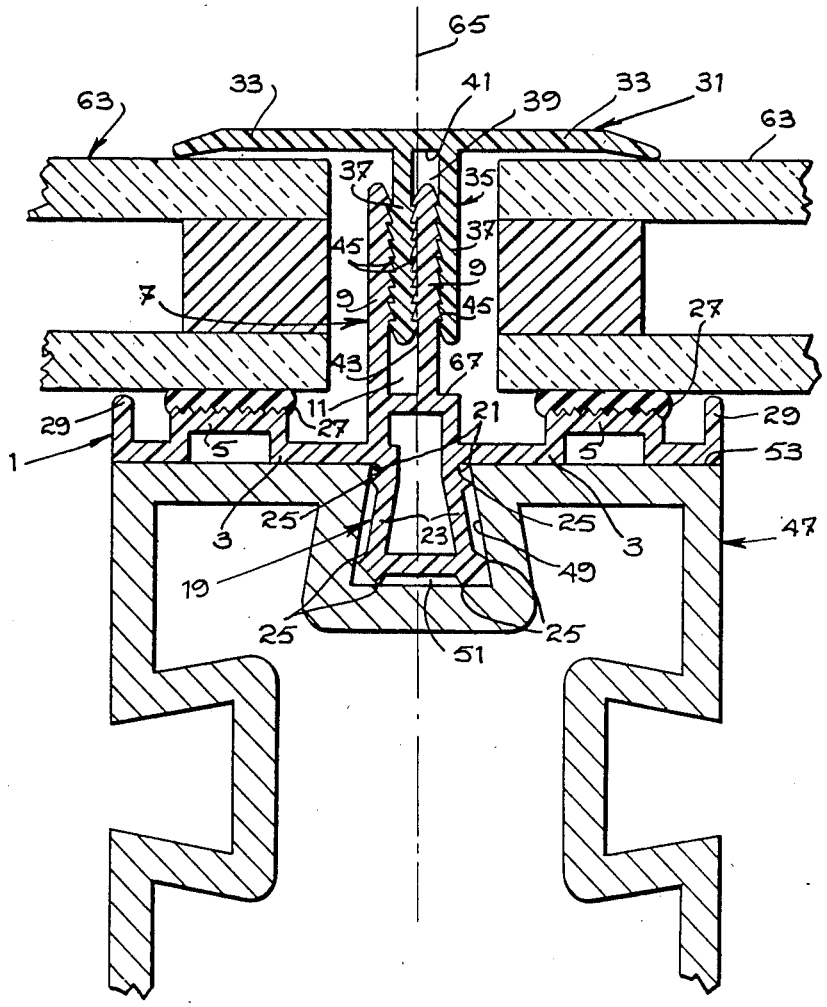
FIG. 2 is a cross-sectional view of a first and a second joint element made according to the invention and interlocked together, being further shown as mounted on a support member.

The primary or first joint element 1 shown in FIGS. 1 and 2 has a generally cross-like shape, when viewed in cross-section. It comprises a pair of aligned lateral arms 3 each formed with a pedestal 5 projecting from one face of the arms 3, each pedestal 5 having a free end of which the surface is roughened by the provision of serrations 6 and for a purpose to be determined hereinafter. Integral with the lateral arms 3 and at adjoining ends thereof is a U-shaped first connector member 7 which is formed of a pair of straight legs 9 spaced from one another so as to define a chamber 11 having a bottom 13 and an open end 15. As shown, the legs 9 project perpendicularly from the face of the lateral arms 3 from which the pedestals 5 project. Projecting from the facing surfaces of the legs 9, inwardly of the chamber 11, are series of teeth 17 that are inclined toward the bottom 13 of the chamber 11.

The first joint element 1 further has a second connector member 19 which is integral with the lateral arms 3 and projects perpendicularly from the other face of the arms at their adjoining ends. Connector member 19 has a narrow neck portion 21 joining the lateral arms 3 and a wide portion 23 extending from the narrow neck portion. As shown in FIGS. 1 and 2, the second connector member 19 is trapezoidal in cross-section with the small base acting as the narrow neck 21. The lateral faces, inclined toward the narrow neck portion 21 as well as the wide base end face are provided with pointed ridges 25.

Figure 5:
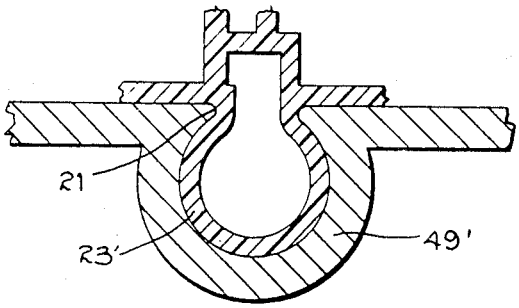
FIG. 5 is a cross-sectional view of a modified form of the primary or first joint element.

Alternatively, and as shown in FIG. 5, the second connector member may be outwardly circular in cross-section as at 23'.

The first joint element 1 is preferably made of heat insulating material, being moulded out of plastic material for instance. For strengthening purposes, the pedestals 5 may be step-like formations as clearly shown in FIGS. 1 and 2.

As mentioned previously, the outer surfaces 6 of the pedestals 5 are roughened so that pads 27 (FIG. 2) of heat insulating cushioning material may be readily fixed thereto. As shown, the pedestals 5 are provided intermediate the ends of the lateral arms 3.

The lateral arms 3 are inwardly turned at the outer ends thereof thus defining flanges 29 having rounded tips and terminating at a higher level than the level of the anti-slip surfaces of the pedestal 5 while, as illustrated in FIG. 2, ending at a lower level than the outer level of the pads 27 of cushioning material.

Referring to FIG. 2, there is shown a secondary joint element 31 which has a body which is generally T-shaped in cross-section and which comprises a pair of aligned lateral arms 33 integral with one another. Similarly to the first connector member 7 of the first joint element 1, the second joint element 31 has a third connector member 35 having a pair of straight legs 37 spaced from one another to define a chamber 39 therebetween, the latter, like chamber 11 of the first connector member 7 having a bottom 41 and an open end 43. The legs 37 are provided with a series of teeth 45 inclined toward the bottom 41.

The chambers 11 and 39 of the first and third connectors 7 and 35 are, as shown, equal in width while the thickness of the legs 9 and 37 are essentially equal to the width of the chambers so that the legs may be slid into the respective chambers for interengagement of the teeth and interlocking of the first and third connector members as is readily apparent from FIG. 2. It will also be noted that the insertion of the legs into the chambers may be at a selective depth corresponding to the desired width between the arms 3 of the first element 1 and 33 of the second element 31.

Figure 3:
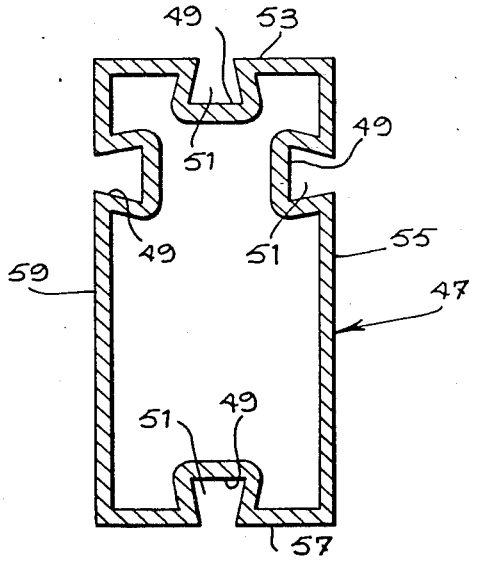
FIG. 3 is a cross-sectional view of a support member.

As mentioned previously, a principal object of the invention is to provide a primary structural joint having means such as the aforedescribed second connector member 19 by which it is possible to fix the first joint element 1 readily to a support in the nature of a column, a roof rafter, a beam or the like structural element. A support of this nature is shown in FIGS. 2 and 3.

As shown, such a support 47 is hollow and generally rectangular in cross-section. Means, such as inwardly located confining walls 49, define a series of housings 51 all of which open up into flat surfaces 53, 55, 57 and 59. Each housing 51 is configured to suit the outer outline of the second connector member 19 so that the latter can easily but snugly fit therein as shown in FIG. 2. In the latter case, the housings 51 are obviously trapezoidal in cross-section. In this case, the pointed ridges 25 help slide the member 19 in the housing 51 with the aligned lateral arms 3 of the first joint element 1 abuttingly resting on the flat surface 53 of the support 47, in the embodiment shown in FIG. 2.

FIG. 2 clearly illustrates how glass panels, such as thermopane panels, can easily be mounted on a columnar or beam support 47. A first joint element 1 is slid into position in a housing 51 and adjacent edges of a pair of glass panels 63 applied against the cushioning pads 27. The second joint element 31 is then applied over the outer surfaces of the edges of the panels 63, the relevant legs 9 of the first connector member 7 interlocking with the legs 37 of the third connector member 35, the said legs being driven into the chambers 11 and 39 to the required depth sufficient to securely apply the panels 63 against the cushioning pads 27. Firm holding of the panels 63 is ensured by the flexibility of the plastic material of which the second joint element 31 is made, the flexibility being improved by having the outer edges of the second joint element 31 turned inwardly toward the panels 63, as clearly shown in FIG. 2.

In order to provide for symmetry in the joint and equal application of pressure on the adjoining edges of the panels 63, the first connector member 7 is somewhat offset from the center line 65 of the second connector member 19 and on either side of the center line 65. This configuration results, as shown in FIG. 2, in a small ledge 67 at the bottom of the righward leg 9 of the first connector member 7.

In order also to allow proper application of the panels 63 against the cushioning pads 27, the top surface of the latter should project slightly beyond the tips of the inturned flanges 29 of the first joint element 1, reference being again made to FIG. 2.

It will also be appreciated that the wide portion 23 of the second connector member 19 may be outwardly circular in cross-section as at 23', illustrated in FIG. 5, in which case the confining wall means is likewise inwardly circular as at 49'.

Figure 4:
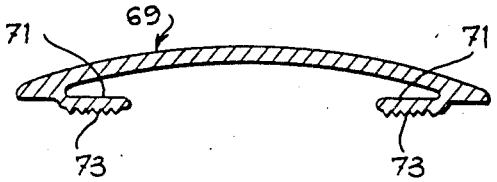
FIG. 4 is a cross-sectional view of a decorative cover which is releasably mountable over the second joint element.

It may also be appropriate to provide a decorative cover 69, FIG. 4, having inwardly turned ends 71 to allow the cover 69 to be slid over the second joint element 31. As the inwardly turned ends 71 would then be applied against the outer faces of the panels 63, it is preferred that they be serrated as at 73 to provide a better grip. Cover 69 would preferably be made of aluminum.

The embodiments of the invention in which an exclusive property or privilege is claimed are defined as follows:

1. A structural joint including a first and a second joint element, said first joint element having a generally cross-like, body comprising:

a pair of aligned lateral arms, each arm having opposed faces and an end and being formed with a pedestal projecting from one of said opposed faces, each pedestal having a free end with a roughened anti-slip surface;

a U-shaped first connector member having a pair of straight legs spaced from one another to define therebetween a chamber having a bottom and an open end, said legs projecting perpendicularly from said one face and being integral with said lateral arms at adjoining ends of said lateral arms;

a second connector member integral with said lateral arms and projecting perpendicularly from the other one of said opposed faces of said lateral arms and perpendicularly from said adjoining ends; said second connector member having a narrow neck portion joining said lateral arms and a wide portion extending from said narrow neck portion;

a series of teeth on each of said legs of said first connector member and inwardly of said chamber of said first connector member, said teeth being inclined toward said bottom of said chamber of said first connector member, and a further series of like teeth on one only of said legs outwardly of said chamber;

said second joint element having a generally T-shaped body comprising:

a pair of aligned lateral arms integral with one another and having an inner face;

a U-shaped third connector member having a pair of straight legs spaced from one another to define therebetween a chamber having a bottom and an open end, said legs projecting perpendicularly from said inner face of said lateral arms and being integral with said lateral arms at adjoining ends of said lateral arms;

a series of teeth on each of said legs of said third connector member and inwardly of said chamber of said third connector member, said teeth being inclined toward said bottom of said chamber of said third connector member, and a further series of like teeth on one only of said legs outwardly of said chamber, wherein said chambers of said first and third connectors are equal in width and the thickness of one of said legs of each of said first and third connector members is essentially equal to said width of said chambers, said legs being slid into respective ones of said chambers for interengagement of said teeth and interlocking of said first and third connector members selectively at one of a plurality of locations within said chambers, wherein said lateral arms of said second joint element are of equal width and are separated by a center line perpendicular thereto, and said second connector member has a longitudinal axis coaxial with said center line, and wherein said chambers defined by said pairs of legs of said first and third connector members have center lines parallel with and offset from said longitudinal axis, on either side thereof.

2. A structural joint as claimed in claim 1, wherein said second connector member is trapezoidal in cross-section, having a small base portion acting as said narrow neck.

3. A structural joint as claimed in claim 2, wherein said trapezoidal connector member has lateral faces inclined inwardly toward said narrow neck and pointed ridges projecting from said lateral faces; said trapezoidal connector member further having a wide base end face and pointed ridges projecting from said wide base end face.

4. A structural joint as claimed in claim 3, wherein said pedestals are step-like formations located between the ends of said lateral arms of said first joint element.

5. A structural joint as claimed in claim 4, further comprising flanges at the ends of said lateral arms away from said first connector member, said flanges terminating at a predetermined level higher than said antislip surfaces of said pedestals.

6. A structural joint as claimed in claim 4, further comprising pads of heat insulating cushioning material fixed on said anti-slip surfaces of said pedestals.

7. A structural joint as claimed in claim 6, wherein said pads have a cushioning surface and further comprising flanges at the ends of said lateral arms away from said first connector member, said flanges terminating at a predetermined level higher than said anti-slip surfaces of said pedestals but at a lower level than said pads.

8. A structural joint as claimed in claim 4, wherein said cross-like body is made of heat insulating material.

9. A structural joint as claimed in claim 1, wherein said wide portion of said second connector member is outwardly circular in cross-section.

10. A structural joint as claimed in claim 1, further comprising: a hollow structural support having a flat surface over which said lateral arms of said first joint element abuttingly rest and means on said support defining a housing opening into said flat surface and configured for and lodging said second connector member by sliding engagement of said second connector member in said housing.

11. A structural joint as claimed in claim 10, wherein said lateral arms of said second joint element bend inwardly at the ends thereof.

12. A structural joint as claimed in claim 11, further comprising a decorative cover having inwardly turned ends, said cover being slid over said lateral arms of said second joint element.

* * * * *